United States Patent [19]

Flynn

[11] 4,225,170

[45] Sep. 30, 1980

[54] LOG SIDELOADER

[76] Inventor: Dennis E. Flynn, 588 W. 11th, Winner, S. Dak. 57580

[21] Appl. No.: 65,576

[22] Filed: Aug. 10, 1979

[51] Int. Cl.[3] ..... A47J 49/14

[52] U.S. Cl. ..... 294/11

[58] Field of Search ..... 294/11, 8.5, 10, 13, 294/19 R, 22, 23, 50.8, 50.9, 104, 115

[56] References Cited

U.S. PATENT DOCUMENTS

| | | | |
|---|---|---|---|
| 2,125,214 | 7/1938 | Apfel et al. | 294/11 |
| 2,429,046 | 10/1947 | Billig | 294/11 |
| 4,105,238 | 8/1978 | Stright | 294/11 |

*Primary Examiner*—James B. Marbert

*Attorney, Agent, or Firm*—Clarence A. O'Brien; Harvey B. Jacobson

[57] ABSTRACT

An elongated tubular arm of non-circular internal and external cross-sectional shape is provided and has a first elongated transverse jaw carried thereby and projecting outwardly of one side of the arm. The jaw defines a transverse non-circular opening in one end closely slidably receiving the arm therethrough for longitudinal shifting of the jaw along the arm. An elongated operator of non-circular cross-sectional shape is slidingly telescoped in the arm and a first end of the operator projects outwardly of the corresponding end of the arm. A second elongated transverse jaw has one end supported from the operator first end and projects outwardly of the side thereof corresponding to the aforementioned side of the arm in opposition to the first jaw. Actuator structure is operatively connected between the arm and the operator for shifting the operator toward a predetermined position relative to the arm in a direction retracting the first end of the operator relative to the corresponding arm end and the portions of the first jaw defining the transverse opening therein and the external surfaces of the arm along which the first jaw is slidable coact to frictionally lock the first jaw in shifted position along the arm in response to slight relative angular displacement of the first jaw and the arm about an axis transverse to the first jaw and arm.

10 Claims, 6 Drawing Figures

44
30
34
50
20
14
10
30
18
22
52
16
12

50
30

34
36
26
18
4
5
28
32
20
22
30
5
4

50
40

38
42
44
36
34
20
46
48

20
24
22

28
20
30

18

22
30
54

LOG SIDELOADER

BACKGROUND OF THE INVENTION

Various forms of tools have been heretofore provided for engaging, lifting and placing firewood logs in proper position within fireplaces. In addition, other forms of tools for engaging and assisting in proper placement of solid fuel components have also been used heretofore. However, tools for handling and lengthwise feeding logwood sections into a wood stove firebox have not been heretofore provided. Accordingly, a need exists for a tool which will enable a person to engage, support and lengthwise feed logwood sections into a wood stove firebox.

Examples of various tools for engaging and lifting cylindrically shaped and other objects and which include some of the general structural and operational features of the instant invention are disclosed in U.S. Pat. Nos. 1,021,290, 1,526,517, 1,853,899 and 3,156,444.

BRIEF DESCRIPTION OF THE INVENTION

The log loader of the instant invention is constructed in a manner whereby a section of logwood may be lengthwise engaged, lifted and longitudinally fed into a wood burning stove or heater firebox.

The loader includes an elongated support arm from which a pair of laterally projecting and opposing elongated transverse jaw members project. One of the jaw members is manually adjustably positionable along the arm for frictional maintainment of adjusted position along the arm and the arm is tubular and has an elongated operator longitudinally slidably received therethrough with one end of the operator projecting outwardly of the corresponding end of the arm and having a second elongated transverse jaw supported therefrom in opposition to the first jaw. Actuator structure is operatively connected between the arm and the operator for shifting the operator in a direction to move the second jaw supported therefrom toward the first arm support jaw. The opposite ends of a wood log section may be gripped between the outer ends of the jaws and thus the entire elongated log loader, including the log section lengthwise supported therefrom, may be lengthwise advanced in order to lengthwise insert the supported log section through an appropriate opening into the combustion chamber or firebox of a wood burning stove or heater.

The main object of this invention is to provide a tool which will greatly facilitate the task of lengthwise loading elongated log sections into a wood burning stove or heater firebox.

Another object of this invention is to provide a tool which will be readily adjustable to handle logs of different lengths.

Still another important object of this invention is to provide a log loader which will be capable of endwise loading logs of different diameters into the firebox or combustion chamber of a wood stove or heater.

A final object of this invention to be specifically enumerated herein is to provide a log loader in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
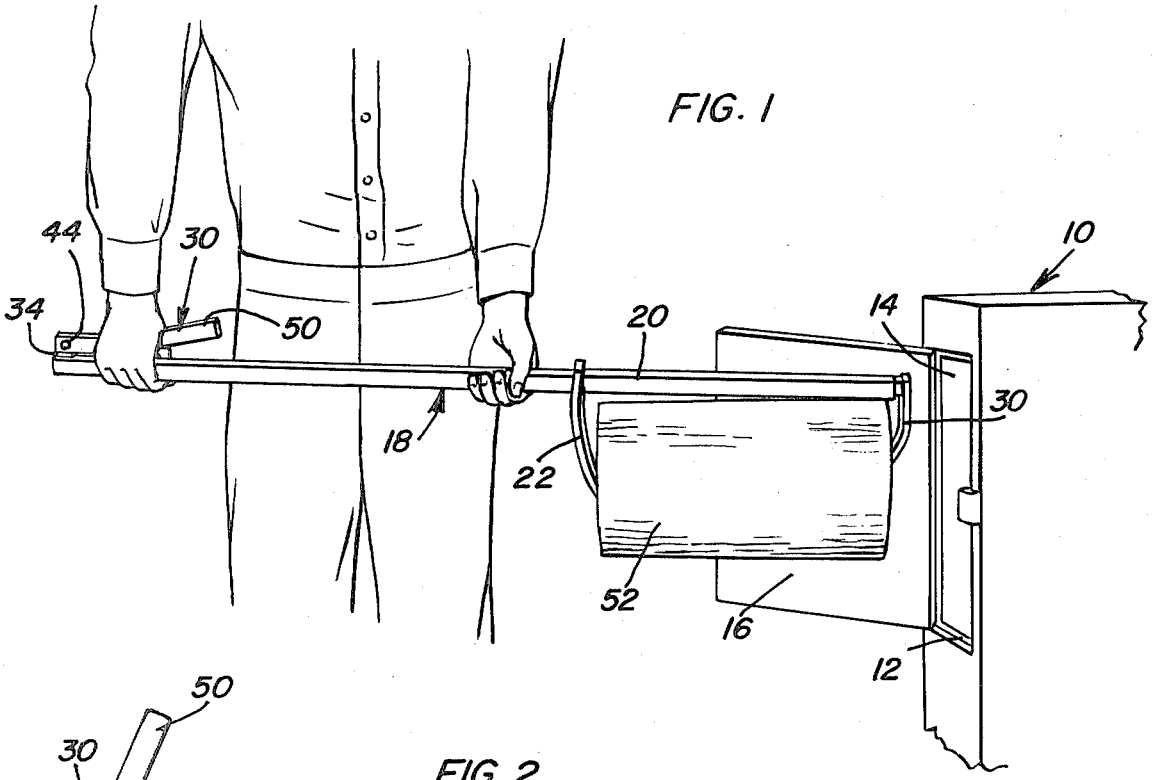
FIG. 1 is a perspective view of the log sideloader of the instant invention being supported in the hands of the user thereof preparatory to lengthwise inserting a wood log section into a wood burning heater or stove.

Referring now more specifically to the drawings, the numeral 10 generally designates a conventional form of wood burning heater including a side opening 12 leading into a firebox or combustion chamber 14. The heater 10 includes a hinged door 16 for removably closing the opening 12.

The log loader of the instant invention is referred to in general by the reference numeral 18 and includes an elongated tubular arm 20 which is generally square in external and internal cross-sectional shape. The arm 20 supports a first elongated transverse jaw 22 therefrom. The jaw 22 has a rectangular opening 24 formed through one end thereof through which the arm 20 is closely slidably received. The width of the opening 24 is but slightly greater than the transverse width of the arm 20 and the height of the opening 24 is also slightly greater than the vertical thickness of the arm 20, although additional clearance is afforded the arm 20 between the upper and lower limits of the opening 24. In this manner, the first jaw 22 may be readily slid along the arm 20 to a desired position thereon, but any tendency to angularly displace the jaw 22 about an axis transverse to the jaw 22 and the arm 20 will effect a locking action between the opposing upper and lower surface of the arm 20 and the surfaces of the jaw 22 defining the upper and lower limits of the opening 24 in order to lock the jaw 22 in position on the arm 20.

An elongated operator 26 of substantially square outside cross-sectional shape is longitudinally slidably received through the arm 20 and is thus keyed to the arm 20 against angular displacement relative thereto about an axis extending longitudinally of the operator 26. One end 28 of the operator 26 projects outwardly of the corresponding end of the arm 20 and has a second elongated transverse jaw 30 supported therefrom. One end of the jaw 30 is anchored relative to the end 28 of the operator 26 and the other end of the jaw 30 opposes the outer end of the jaw 22, the outer ends of the jaws 22 and 30 being slightly outwardly convergent.

Figure 2:
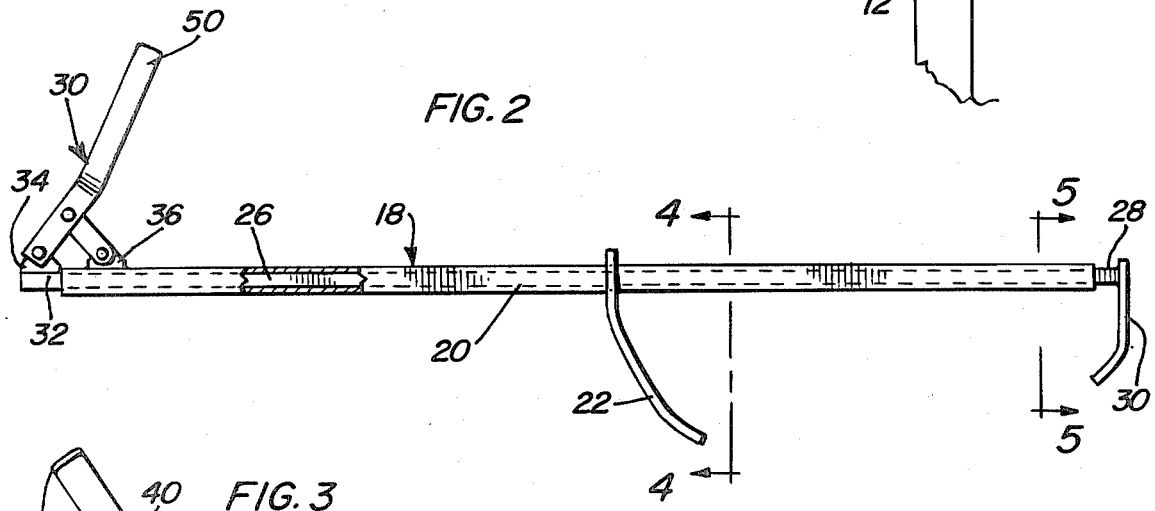
FIG. 2 is an enlarged side elevational view of the sideloader with portions thereof being broken away and illustrated in longitudinal vertical section.
Figure 3:
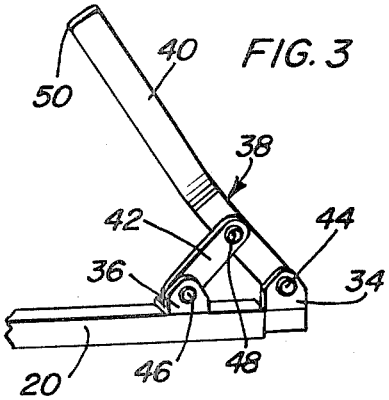
FIG. 3 is a fragmentary perspective view of the actuator structure for the sideloader as seen from the rear side thereof illustrated in FIG. 2.
Figure 4:
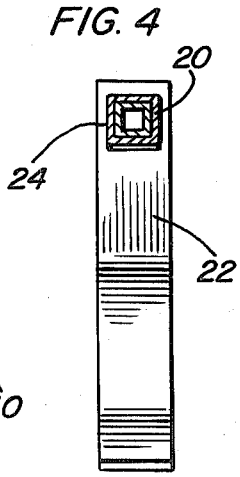
FIG. 4 is an enlarged fragmentary transverse vertical sectional view taken substantially upon the plane indicated by the section line 4–4 of FIG. 2.
Figure 5:
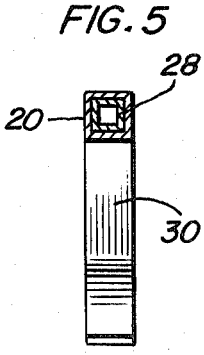
FIG. 5 is an enlarged fragmentary longitudinal vertical sectional view taken substantially upon the plane indicated by the section line 5—5 of FIG. 2.

As may best be seen from FIGS. 2 and 3 of the drawings, the end 32 of the operator 26 remote from the end 28 has a mounting flange 34 supported therefrom and the corresponding end of the arm 20 has a similar flange 36 mounted thereon. A toggle lever assembly referred to in general by the reference numeral 38 and including an elongated lever 40 and a connecting link 42 is operatively connected between the flanges 34 and 36. One end of the lever 40 is pivotally connected to the flange 34 as at 44, one end of the connecting link 42 is pivotally connected to the flange 36 as at 46 and the other end of the connecting link 42 is pivotally connected to an intermediate portion of the lever 40 as at 48. The free or outer end 50 of the lever 40 remote from the flange 34 is swingable downwardly toward the arm 20 from the position thereof illustrated in FIGS. 2 and 3 of the drawings in order to effect longitudinal shifting of the operator 26 in a direction to retract the end 28 relative to the corresponding end of the arm 20, whereby the second jaw 30 will be displaced toward the first jaw 22 for the purpose of clamping a log section, such as the log section 52 illustrated in FIG. 1, between the jaws 22 and 30. When the free end 50 of the lever 40 is swung to its limit position toward the arm 20, it is disposed in a slightly over center position whereby the jaws 22 and 30 of the log loader will automatically maintain the leg section 52 clamped therebetween during manipulation of the log loader 18 to lengthwise insert the leg section 52 through the opening 12 into the firebox or combustion chamber 14 of the heater 10.

Figure 6:
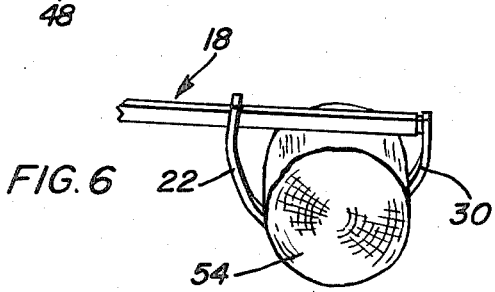
FIG. 6 is a fragmentary perspective view of the instant invention illustrating the manner in which it may also be utilized to transversely clamp and support a logwood section therefrom.

As may be seen in FIG. 6 of the drawings, the log loader 18 may also be utilized to transversely clamp and support a log section 54 between the jaws 22 and 30. The outer ends of the jaws 22 and 30 are slightly convergent whereby the log section 54 may be somewhat cradled between the jaws 22 and 30.

The structure of the log loader 18 enabling the jaw 22 to be adjusted longitudinally of the arm 20 enables the log loader 18 to be utilized in conjunction with log sections of different lengths. In operation, with the toggle lever assembly 38 in the release position thereof illustrated in FIGS. 2 and 3 of the drawings, one end of a log section may be engaged by the outer end of the jaw 30 and the jaw 22 may be adjusted along the arm 20 toward the jaw 30 until the free end of the jaw 22 engages the opposite end of the log section. Then, the toggle lever assembly 38 may be actuated from the position thereof illustrated in FIGS. 2 and 3 to the over center position thereof illustrated in FIG. 1 of the drawings whereby the jaw 30 will be moved toward the jaw 22, the latter will be slightly angularly displaced relative to the arm 20 about an axis extending transverse to the jaw 22 and the arm 20 in order to lock the jaw 22 in adjusted position along the arm 20 and the log section will be clamped between the free ends of the jaws 22 and 30.

It will, of course, be noted that the loader 10 may also be utilized to clampingly engage and support other articles. Further, inasmuch as the operator 26 is keyed to the interior of the arm 20 against rotation about its longitudinal axis relative to the arm 20 and the jaw 22 is keyed to the arm 20 against angular displacement relative thereto about an axis extending longitudinally of the arm 20, the jaws 22 and 30 are maintained in generally parallel relationship projecting from the same side of the loader 18.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A log handle for engaging, supporting and lengthwise feeding log wood sections into a wood stove firebox, said handler including an elongated tubular arm, a first elongated transverse jaw carried by and projecting outwardly of one side of said arm and defining a transverse opening in one end closely slidably receiving said arm therethrough for longitudinal shifting of said jaw along said arm and frictional locking of said jaw in shifted position along said arm is response to slight relative angular displacement of said jaw and arm about an axis transverse to said arm and jaw, an elongated operator slidingly telescoped in said arm with one end thereof projecting outwardly of the corresponding end of said arm, a second elongated transverse jaw having one end supported from said operator and projecting outwardly of the side thereof corresponding to said one side of said arm in opposition to said first jaw, and actuator means operatively connected between said arm and operator for shifting said operator toward a predetermined position relative to said arm in a direction retracting said one end of said operator relative to said corresponding arm end.

2. The combination of claim 1 wherein said actuator means includes a toggle link assembly including an over center position to which said toggle link assembly is shifted as a result of actuation thereof to shift said operator to said predetermined position.

3. The combination of claim 2 wherein said toggle link assembly includes an actuating lever disposed generally parallel to said arm when said toggle link assembly is in said over center position.

4. The combination of claim 1 wherein said tubular arm and actuator include complementary internal and cross-sectional shapes keying said operator to said arm against angular displacement of said operator about its longitudinal axis relative to said arm.

5. The combination of claim 1 wherein said arm includes a non-circular external cross-sectional shape and said opening in said first jaw is of a complementary cross-sectional shape whereby said first jaw is keyed to said arm against angular displacement relative thereto about an axis extending longitudinally of said arm.

6. The combination of claim 5 wherein said tubular arm and actuator include complementary internal and cross-sectional shapes keying said operator to said arm against angular displacement of said operator about its longitudinal axis relative to said arm.

7. The combination of claim 1 wherein said elongated jaws include outer ends which converge toward each other.

8. The combination of claim 7 wherein said tubular arm and actuator include complementary internal and cross-sectional shapes keying said operator to said arm against angular displacement of said operator about its longitudinal axis relative to said arm.

9. The combination of claim 8 wherein said arm includes a non-circular external cross-sectional shape and said opening in said first jaw is of a complementary cross-sectional shape whereby said first jaw is keyed to said arm against angular displacement relative thereto about an axis extending longitudinally of said arm.

10. The combination of claim 9 wherein said actuator means includes a toggle link assembly including an over center position to which said toggle link assembly is shifted as a result of actuation thereof to shift said operator to said predetermined position.

* * * * *